US005411254A

United States Patent [19]

Dressler et al.

[11] Patent Number: 5,411,254

[45] Date of Patent: May 2, 1995

[54] TENNIS RACKET

[76] Inventors: Keith B. Dressler, 6750 Hickory Brook Rd.; Philip H. Johnson, 2135 Mae Dell Rd., both of Chattanooga, Tenn. 37421

[21] Appl. No.: 319,315

[22] Filed: Oct. 6, 1994

[51] Int. Cl.[6] ..... A63B 49/08

[52] U.S. Cl. ..... 273/73 J; 273/73 R

[58] Field of Search ..... 273/73 R, 73 J, 75, 273/67 R, 72 R, 81 R, 81.2 R

[56] References Cited

U.S. PATENT DOCUMENTS 4,712,795 12/1987 Wang ..... 273/73 R
4,811,947 3/1989 Takatsuka et al. ..... 273/73 J
5,263,275 11/1993 Rumbaugh ..... 273/73 J X

*Primary Examiner*—Raleigh W. Chin
*Attorney, Agent, or Firm*—Alan Ruderman

[57] ABSTRACT

A tennis racket has a head and a handle extending from the head, the handle having an internal cavity extending from the end of the handle toward the head. A measuring aid such as a telescopic wand is mounted within the cavity and may be extended for use in positioning the height of the tennis net above the surface of the court. When extended, the distance from the end of the telescopic wand to the remote end of the head equals the three foot specification required for the height of the net. The wand may be retracted into the handle when not used as a measuring aid so that the racket may play in conventional manner.

4 Claims, 1 Drawing Sheet

TENNIS RACKET

BACKGROUND OF THE INVENTION

This invention relates to tennis rackets and more particularly to a tennis racket having an extendible measuring device within the handle of the racket which when extended may be used together with the frame of the racket to accurately position the height of a tennis net, and which may be retracted into the handle when inoperative.

The game of tennis utilizes a net which extends across the center of the tennis court and over which the ball must be hit from one end of the court to the other end. The mid-point of the net between the sides of the court is specified to be three feet above the surface of the court. The height of the net is adjustable by means of adjusting the tension on the net mounting cords at the ends of the net adjacent the sides of the court. As the tension changes due to various factors such as stretching of the net or the tensioning cords, the height of the net at the mid-point may change out of specification. In tournament play the mid-point height of the net is critical and is measured with extreme accuracy and reset so as to be within the specification set by the rules. In recreational play, however, measuring devices often may not readily be available for the players to determine if the height of the net is positioned correctly. Since playing time available on a court is usually limited, players may not seek out a measuring device and may play with the net positioned at an incorrect height.

The length of a conventional tennis racket is too short to be used as a measuring device to set the height of the net. Most rackets are 27 inches in length from the top of the head to the tail of the handle and thus are 9 inches short of the three foot net height specification. Thus, conventional tennis rackets do not provide a means for correctly positioning the mid-point of the net relative to the playing surface of the court.

SUMMARY OF THE INVENTION

Consequently, it is a primary object of the present invention to provide a readily available means for determining whether the center of the net is positioned properly above the court surface so that the height of the net may be correctly set to specification.

It is another object of the present invention to provide a tennis racket having measuring means which together with the racket body may be used to determine whether the mid-point of the tennis net meets the specification of being three feet above the surface of the court.

It is a further object of the present invention to provide a tennis racket having an extendible measuring device within the handle of the racket which when extended from the handle increases the length of the racket to three feet, the device being retractable into the handle when not needed so that the racket may be used in conventional manner to play the game of tennis.

Accordingly, the present invention provides a tennis racket having a frame or body including a head and a handle extending from the head, the handle having an internal cavity within which a measuring aid is mounted, the measuring aid being extendible selectively from the handle and together with the body of the racket may be used for determining whether a tennis net is positioned at the correct distance above the surface of the court, the measuring aid being retractable back into the handle selectively for use of the racket in conventional manner.

The measuring aid may, as in the preferred form of the invention, comprise a telescopic wand which may be extended from the interior of the handle by manually pulling the free end of the wand in a direction away from the head outwardly and may be retracted back into the handle by pushing the wand toward the head. When extended, the distance from the free end of the wand to the remote end of the head is three feet so that when the head is disposed on the surface of the tennis court the extended free end of the wand is disposed three feet above the court and may be used to determine whether the tennis net is correctly set at the mid-point thereof. Other forms of the invention such as an extendible and retractable tape or string may be utilized within the handle rather than a telescopic wand.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
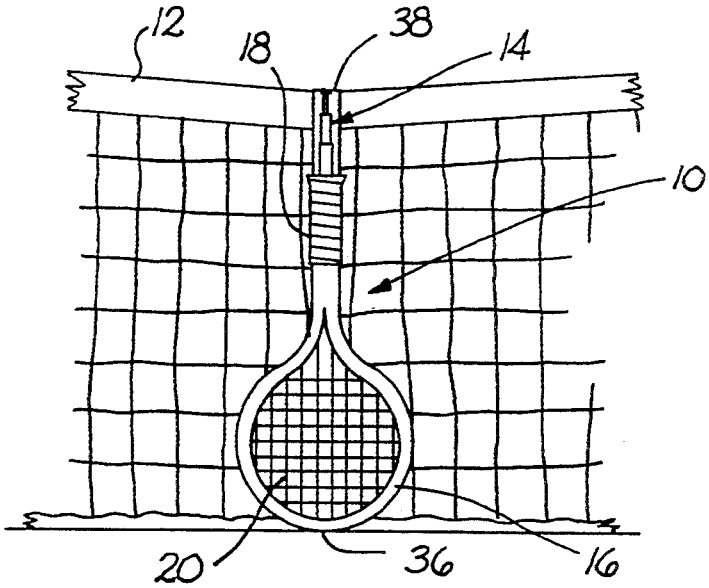
FIG. 1 is an elevational view depicting a fragment of a tennis net and illustrating a tennis racket constructed in accordance with the present invention with the measuring aid in the form of a telescopic wand in the extended position.

Referring to the drawings, a tennis racket 10 constructed in accordance with the present invention is illustrated in a position adjacent a tennis net 12, the tennis racket having a measuring aid 14 disposed in extended position for measuring the height of the net at the center thereof. The tennis racket conventionally comprises a frame having a head 16 and a handle 18, the head having an oblong shape elongated from a circular form and having a mesh of strings 20 extending lengthwise and width-wise therein.

Figure 3:
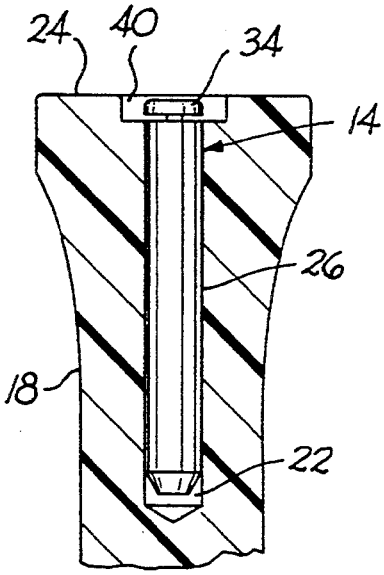
FIG. 3 is a view similar to FIG. 2, but with the wand retracted into the handle.
Figure 4:
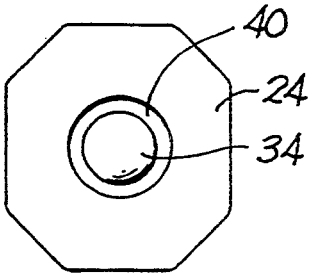
FIG. 4 is an end view of the tail end of the handle of the tennis racket illustrated in FIG. 3.
Figure 2:
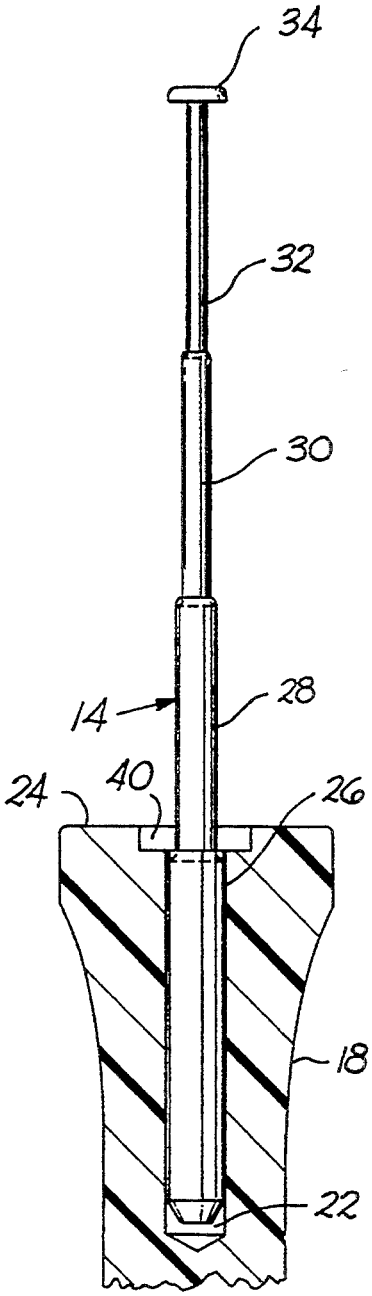
FIG. 2 is a fragmentary cross sectional view of the tail end of the handle of the tennis racket illustrated in FIG. 1 with the wand extended from the handle.

In the preferred form of the invention, as illustrated in FIGS. 2 and 3, the handle 18 includes an elongated hollow internal bore or cavity 22 extending from the tail end 24 of the handle toward the head end of the racket. Secured within the cavity 22 by gluing or the like is a hollow housing in the form of a cylindrical sleeve 26. A second, but smaller diameter, hollow cylindrical sleeve 28 is snugly but slidably received within the sleeve 26. In a similar manner a third hollow cylindrical sleeve 30 may be snugly and slidably within the sleeve 28 and a fourth sleeve 32 may be snugly and slidably received within the sleeve 30, the diameter of the sleeve 30 being smaller than that of the sleeve 28 but larger than the sleeve 32. Each sleeve is precluded by conventional means from being fully withdrawn out of the larger diameter sleeve within which it may be nested. Preferably each sleeve may be formed from synthetic plastic material and therefor be light weight. A small manually graspable knob or disk-shaped button 34 preferably is disposed at the end of the sleeve 32. The sleeves 28, 30, 32 thus form a telescopic wand which may be received within the housing sleeve 26 and thus nested in the handle in the retracted position, or may be telescopically extended out of the handle in the operative position by grasping the button 34 to pull it and the sleeves 28, 30, 32 to their full length out of, but not removed from the housing sleeve 26.

Although the number of sleeves may be varied, in the preferred embodiment, as illustrated, there are three extendible sleeves. Thus, in order that the distance from the end 36 of the head 16 to the end of the sleeve 32, i.e., to the button 34, be equal to the three foot distance required for setting the height of the net at the center 38 to specifications when using a conventional 27 inch tennis racket, each sleeve need only be three inches. Accordingly, the depth of the cavity 22 is only required to be equal to or slightly greater than three inches. Such a depth within the handle will not have detrimental effects on the balance or the "play" of the racket, and since the sleeves 26, 28, 30, 32 fill the cavity a player should not notice any difference while playing.

If desired, the tail end 24 of the handle 18 may include a shallow recess 40 or similar indentation such that the button 34 may not extend beyond the tail end of the handle when the wand is in the retracted position. Such a recess, if desired, need be no greater in depth than that of the thickness of the button and need not be substantially greater in diameter than that of the button.

Although the preferred form of the invention is disclosed as having the telescopic wand, other measurement aiding means which may be stored within and yet retractable from the handle are contemplated within the scope of the invention. For example, an extendible tape wound about a reel within a cavity in the handle is one such means. If desirable, the tape may be extended selectively against the action of a spring which may therefore retract the tape into the handle. A simple string tied at one end about a pin or peg within a cavity in the handle and which may be manually pulled out and pushed back into the cavity is another such arrangement. The only limitations on such means is that the distance from the end of the head to the end of the measuring aid be equal to the three foot net height specification requirement.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tennis racket having a frame including a head and a handle extending from the head, said racket having a first end defined at least by a point on said head disposed furthest from said handle, and a second end defined by at least a point on said handle disposed furthest from said head, a cavity formed in said handle extending from said second end toward said head, a measuring aid having a fixed end secured within said cavity and a free end normally disposed within said cavity and extendible selectively out of said cavity beyond said second end, the distance from said first end to said free end being substantially equal to three feet when said free end is fully extended out of said cavity.

2. A tennis racket as recited in claim 1, wherein said measuring aid comprises a plurality of nestable telescopically extendible and retractable sleeves including an inner sleeve and an outer sleeve, and means for securing said outer sleeve within said cavity.

3. A tennis racket as recited in claim 2, wherein the inner sleeve includes a knob disposed on an end thereof most remote from said handle when in the extended position for manual grasping when said sleeves are within said handle for aiding in extending said sleeves.

4. A tennis racket as recited in claim 3, wherein said second end of said handle includes a recess for receiving said knob when said sleeves are retracted into said handle.

* * * * *